United States Patent [19]

Hamilton et al.

[11] 3,934,441

[45] Jan. 27, 1976

[54] CONTROLLED ENVIRONMENT SUPERPLASTIC FORMING OF METALS

[75] Inventors: Charles Howard Hamilton, San Pedro; Fred B. Koeller, Manhattan Beach; Roger S. Raymond, Redondo Beach; Martin Goldberg, Valencia, all of Calif.

[73] Assignee: Rockwell International Corporation, El Segundo, Calif.

[22] Filed: July 8, 1974

[21] Appl. No.: 486,290

[52] U.S. Cl. ..... 72/60; 72/364; 72/342

[51] Int. Cl.[2] ..... B21D 26/04

[58] Field of Search ..... 72/57, 60, 342, 364

[56] References Cited

UNITED STATES PATENTS

| | | | |
|---|---|---|---|
| 3,339,387 | 9/1967 | Myers | 72/364 |
| 3,440,858 | 4/1969 | Motley et al. | 72/364 |
| 3,535,766 | 10/1970 | Hymes | 29/421 |
| 3,572,073 | 3/1971 | Dean et al. | 29/421 |
| 3,595,060 | 7/1971 | Hundy | 72/364 |
| 3,646,653 | 3/1972 | Richard | 29/421 |
| 3,698,219 | 10/1972 | Moore et al. | 72/342 |

FOREIGN PATENTS OR APPLICATIONS

| | | | |
|---|---|---|---|
| 1,231,428 | 5/1971 | United Kingdom | 72/36 X |

*Primary Examiner*—Milton S. Mehr
*Attorney, Agent, or Firm*—Charles T. Silberberg

[57] ABSTRACT

Metals such as titanium alloy blanks which are subject to contamination by air at elevated temperatures are precision formed into desired shapes in a controlled environment. The metal worksheet and a shaping member are located within an enclosure. An inert gas environment is provided in the enclosed area. The metal worksheet is heated to a suitable forming temperature and stretched substantially in excess of its original surface area under tensile stress from a fluid pressure loading and formed into the desired shape by interaction with the shaping member. Novel sealing arrangements for the enclosed area of the forming apparatus are provided.

17 Claims, 6 Drawing Figures

CONTROLLED ENVIRONMENT SUPERPLASTIC FORMING OF METALS

BACKGROUND OF THE INVENTION

The forming of titanium alloys into complex configurations by present day processes, for forming parts requiring large tensile elongations, is extremely difficult and in some cases cannot be achieved. Limited tensile elongations, high yield, and moderate modulus of elasticity impose practical limits for ambient temperature forming, and excessive spring-back frequency requires elevated temperature creep sizing. In some parts, forming is done in a 1200°–1400°F temperature range to increase the allowable deformation and to minimize spring-back and sizing problems. However, even with the use of these moderately high temperatures, an extremely expensive integrally heated double-action forming tool is required. Even with these advanced techniques, forming of titanium alloys is still severly limited and compromises in the design of structural hardware are often necessary with attendant decrease in efficiency and increase in weight.

For several years it has been known that titanium and many of its alloys exhibit superplasticity. Superplasticity is the capability of a material to develop unusually high tensile elongations with reduced tendency toward necking, a capability exhibited by only a few metals and alloys and within a limited temperature and strain rate range. Titanium and titanium alloys have been observed to exhibit superplastic characteristics equal to or greater than those of any other metals. With suitable titanium alloys, overall increase in surface area of up to 300 percent are possible.

The advantages of superplastic forming are numerous: Very complex shapes and deep drawn parts can be readily formed; low deformation stresses are required to form the metal at the superplastic temperature range, thereby permitting forming of parts under low pressures (as 15 psi) which minimize tool deformation and wear, allows the use of inexpensive tooling materials, and eliminates creep in the tool; single male or female tools can be used; no spring-back occurs; no Bauschinger effect develops; multiple parts of different geometry can be made during a single operation; very small radii can be formed; and no problems with compression buckles or galling are encountered. However, prior to applicants' invention superplastic forming of titanium and similar reactive metals was impractical because of the high forming temperatures required and the relatively long time in forming. Titanium at the superplastic forming temperature has a strong affinity for most elements. The heating and forming atmosphere is critical to titanium cleanliness which is particularly sensitive to oxygen, nitrogen, and water vapor content. Unless the titanium is protected, it becomes embrittled and its integrity destroyed. Coating materials cannot be used for protection at the superplastic forming temperatures as the coatings and associated binders react with and contaminate the titanium alloy in any type of environment.

The present invention relates generally to a method and apparatus for superplastic forming of metals in a controlled environment. More specifically, the present invention relates to superplastic forming of metal blank into a desired shape by heating the metal blank in a controlled environment and applying a fluid pressure loading to the metal blank causing it to form against a shaping member.

A method for superplastic forming of metals has been disclosed in U.S. Pat. No. 3,340,101 to Fields, Jr., et al. This patent discloses heating or otherwise conditioning a metal to exhibit its effective strain rate sensitivity and then placing the metal in an apparatus for forming. Forming is usually accomplished by a vacuum exerting tensile stress on the metal. However, a male die member can be utilized to initially deform the metal before application of the vacuum, or the male die member can be used in combination with the application of positive pressure. However, this method would not be suitable for superplastic forming of titanium because of the contamination that would result to the surface integrity of the metal due to the heating and forming without a controlled environment. In fact, the patent does not list titanium as one of the metals having superplastic properties and discusses forming temperatures in the range of 600° F. as opposed to the approximately 1450°–1850° F. required by titanium and its alloys. No mention is made in the patent as to protection from contamination. Additionally, forming time, especially with thicker metal sheet is quite lengthy as the amount of differential pressure is limited.

U.S. Pat. No. 3,605,477 to Carlson discloses apparatus for hot forming titanium alloy blanks where the blanks are coated with a high temperature lubricant, preheated to a forming temperature of about 1,000° to 1,500° F., removed and placed in forming equipment in contact only with mated heated forming tools. The forming equipment is maintained at the forming temperature during forming. It is disclosed to use an argon atmosphere in the heater when preheating the titanium blanks to prevent contamination. However the blank is removed from the heater to separate forming equipment where it is formed into the desired shape without the benefit of the controlled environment. For protection, a high temperature lubricant is formed on the titanium sheet. This method while suitable for hot forming of titanium, would be impractical and unsuccessful for superplastic forming. In the superplastic forming temperature range of approximately 1450° to 1850° F, the high temperature forming lubricant itself contaminates the titanium sheet regardless of the environment. In any case, the heater is separate from the forming apparatus and once the titanium sheet is removed from the heater it would be contaminated.

SUMMARY OF THE INVENTION

It is, therefore, an object of the present invention to successfully deform metal blank against and into intimate contact with a die having a surface area extraordinarily greater than the original surface area of the sheet without contaminating the metal surfaces.

It is another object of the present invention to heat and form the metal in the same apparatus.

It is yet another object of the present invention to reduce the forming time in superplastic forming.

It is still another object of the present invention to efficiently seal the forming apparatus.

Briefly, in accordance with the invention, there is provided forming apparatus where a sheet metal diaphram is formed about a shaping member. The diaphram is located in an enclosure and is formed under tensile stress by a fluid pressure loading. Heating means such as press heating platens are provided to heat the metal diaphram to a suitable forming temperature.

Means is provided to control the fluid pressure in the enclosure. Heating and forming of the diaphram takes place in a controlled environment of inert gas or inert gas on one side of the diaphram and vacuum on the other.

Other objects and advantages of the invention will become apparent upon reading the following detailed description and upon reference to the drawings.

While the invention will be described in connection with the preferred embodiment, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

In order for superplastic forming to be successful, it is necessary to use a material that is suitable. The extent to which any material selected will exhibit superplastic properties is predictable in general terms from a determination of its strain rate sensitivity and a design determination of the permissible variation in wall thickness. Strain rate sensitivity can be defined as $m$ where $$m = \frac{d \ln \tau}{d \ln \dot{\epsilon}}$$

and $\sigma$ is stress in pounds per square inches and $\dot{\epsilon}$ is strain rate in reciprocal minutes. Strain rate sensitivity may be determined by a simple and now well recognized torsion test described in the article "Determination of strain — Hardening Characteristics by Torsion Testing," by D. S. Fields, Jr., and W. A. Backofen, published in the proceedings of the ASTM, 1957, Vol. 57, pages 1259–1272. A strain rate sensitivity of about 0.5 or greater can be expected to produce satisfactory results, with the larger the value (to a maximum of 1) the greater the superplastic properties. Maximum strain rate sensitivity in metals is seen to occur, if at all, as metals are deformed near the phase transformation temperature. Accordingly, the temperature immediately below the phase transformation temperature can be expected to produce the greater strain rate sensitivity. For titanium and its alloys the temperature range which superplasticity can be observed is about 1450°F. to about 1850°F. depending on the specific alloy used.

Other variables have been found to affect strain rate sensitivity and therefore should be considered in selecting a suitable metal material. Decreasing grain size results in correspondingly higher values for strain rate sensitivity. Additionally, strain rate and material texture affect the strain rate sensitivity. It has been found that the m-value reaches a peak at an intermediate value of strain rate (approximately $10^{-4}$ in./in./sec.). For maximum stable deformation superplastic forming should be done at this strain rate. Too great a variance from the optimum strain rate may result in a loss of superplastic properties. The present invention is directed to metals whose surfaces would be contaminated at the elevated temperatures required for superplastic forming. Titanium and its alloys are examples of such metals.

Figure 1:
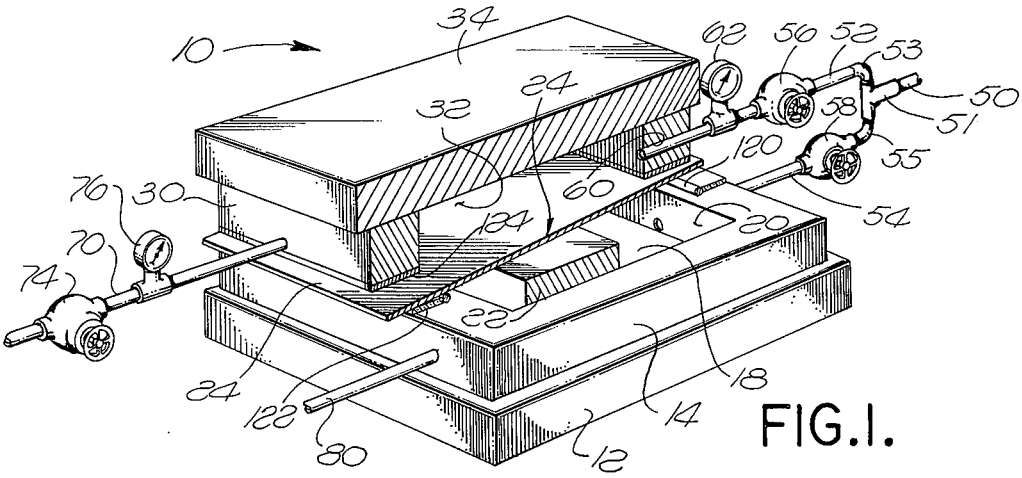
FIG. 1 is a perspective view of the basic forming apparatus employed in superplastic forming of metals in a controlled environment with portions broken away to show internal details.
Figure 2:
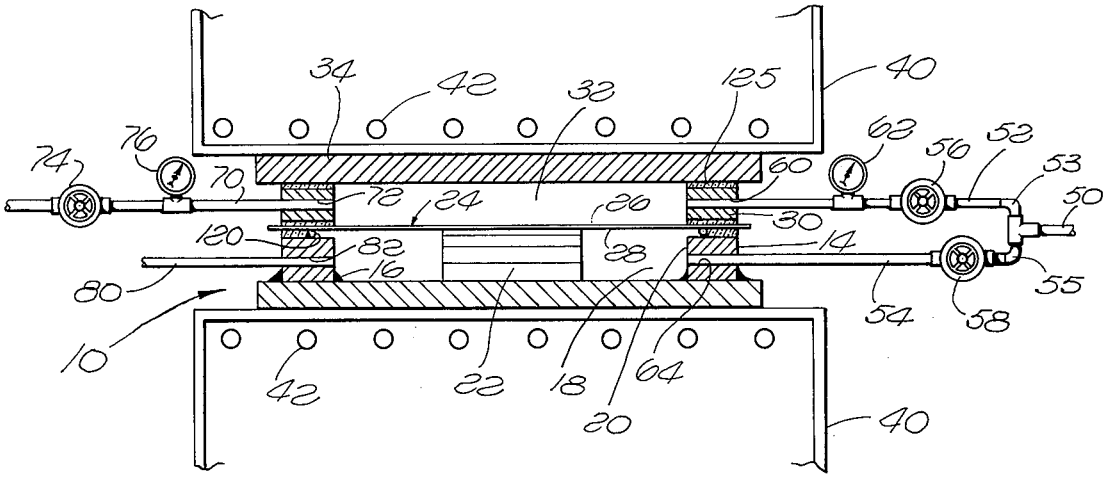
FIG. 2 is a cross-sectional elevational view of the apparatus shown in FIG. 1 mounted between heating platens of a press.

Turning first to FIGS. 1 and 2, there is shown an example of the forming apparatus generally indicated at 10 for carrying out the invention. On a base plate 12 is suitably mounted, as by welding, support tooling frame 14. Tooling frame 14 could also be integral with base plate 12. Tooling frame 14 is in the form of a ring which can be any desired shape, and with base plate 12 defines an inner chamber 18 and a female die surface or shaping member 20. The dimensions of tooling frame 14 and base plate 12 are such that the shaping member 20 is complementary to the shape desired to be formed. One or more male die members 22 can be provided in chamber 18 to vary the shape of the part to be formed. A primary consideration in selection of a suitable shaping member alloy is reactivity with the metal to be formed at forming temperature. When the metal to be formed is titanium or an alloy thereof, iron base alloys with low nickel content and modest carbon content (as 0.2–0.5% carbon) have been successful. Since forming loads are very low, creep strength and mechanical properties are relatively unimportant.

Metal blank 24, preferably in the form of a sheet having upper and lower opposed surfaces 26 and 28 respectively, is supported on tooling frame 14 and covers chamber 18. Any metal blank that exhibits suitable superplastic properties can be used, but the present invention is particularly concerned with such metals that are subject to contamination at forming temperature, such as titanium or an alloy thereof at Ti-6Al-4V. The initial thickness of diaphram 24 is determined by the dimensions of the part to be formed. Upper support tooling frame 30 is mounted over the metal blank 24. Preferably upper frame 30 is dimensionally the same as the lower frame 14 and is mounted in alignment therewith. Tooling frame 30 and diaphram 24 define a chamber 32. Chamber 32 is covered by upper plate 34 which is mounted on upper support tooling frame 30.

The weight of upper plate 34 and support tooling 30 acts as a clamping means for the metal diaphram 24. A single continuous edge of the diaphram 24 is effectively constrained between upper support tooling frame 30 and lower support tooling frame 14. This insures that the final part will be stretched rather than drawn. Should it be desired, additional tightening means such as bolts (not shown) can be employed to more effectively constrain the diaphram 24. As shown in FIG. 2, an additional tightening means employed is a hydraulic press (not shown) having platens 40. The superplastic forming apparatus 10 is placed between platens 40 and compressed thereby assuring that the diaphram 24 is effectively constrained and the chambers sealed from the air. This arrangement is particularly advantageous as the platens can be made of ceramic material and resistance heated wires 42 can be provided in the platens 40 for heating the metal blank 24 to the forming temperature. Heat from the resistance wires 42 is transmitted through plates 12 and 34 to the metal diaphram 24. Other heating methods could be used with the forming apparatus 10 ordinarily surrounded by a heating means if the heating platens are not used.

For contamination prevention of the metal diaphram 24 while heating and forming, an environmental control system is provided. The purpose of the system is to expose the metal diaphram 24 only to inert gas or a vacuum while heating and forming. The metal diaphram 24 will not react with the inert gas due to the nature of the inert gas, even at elevated forming temperatures. In a high vacuum, there are substantially no elements for the diaphram 24 to react with. Thus, in this environment, contamination of the metal diaphram 24 will be prevented. Line 50 is connected to a source of pressurized inert gas at one end (not shown) and into a T-junction member 51 at the other end. The inert gas used is preferably argon in liquid form. Member 51 is connected to two parallel lines 52 and 54 by elbow joints 53 and 55. Line 52 is connected through an orifice 60 in upper tooling frame 30 to chamber 32. For governing the flow of inert gas through line 52 into chamber 32 a valve 56 is mounted in line 52. A pressure gage 62 is also provided in line 52 to indicate up-stream pressure. Line 54 is connected to chamber 18 through an orifice 64 in lower support tooling frame 14. A valve 58 is connected in the line 54 for regulating flow of inert gas into chamber 18. Line 70, which is connected to the opposite side of upper tooling frame 30, through orifice 72 functions as an outlet for inert gas from chamber 32. A valve 74 is provided in the line 70 to govern flow of inert gas through the outlet. A pressure gauge 76 is also connected in line 70 to provide an indication of pressure downstream. Line 80 functions as either an inert gas vent or a vacuum inlet. Line 80 is shown mounted to lower tooling frame 14 through orifice 82. However, it could just as easily be mounted to base plate 12. If line 80 functions as a vacuum inlet, a suction pump (not shown) would be employed in line 80 for creating the vacuum in chamber 18.

Forming of the diaphram 24 is produced by the pressure differential between chambers 18 and 32. This pressure loading can be accomplished in a variety of ways. For example, a constant positive pressure can be maintained in chamber 32 while vacuum is applied to chamber 18, or positive pressure in chamber 32 can be increased to greater than the positive pressure in chamber 18, or positive pressure in chamber 32 could be increased at the same time a vacuum is applied to chamber 18. By using the metal blank 24 as a diaphram which divides two pressure chambers, forming time can be reduced because a vacuum can be applied to one chamber and positive pressure to the other. This allows increase of the pressure differential which increases the strain rate. This is very significant with a thick diaphram. However, the usable strain rate should not be exceeded. Differential pressures used normally vary from 15 psi to 150 psi. Forming times, depending on diaphram thickness and differential pressure, may vary from 10 minutes to 16 hours.

Figure 3:
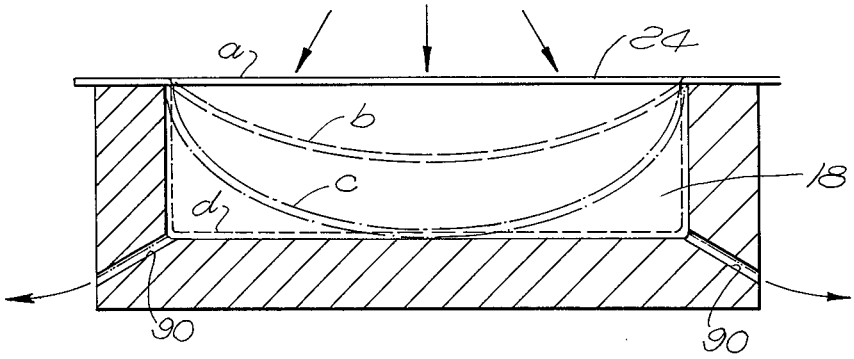
FIG. 3 is a cross-sectional elevational view of a portion of the forming apparatus below the metal diaphram of a modified apparatus illustrating the original position of the metal to be formed, an intermediate position, and the final position of the metal as formed.

FIG. 3 illustrates the forming of the metal diaphram 24. The original position of the diaphram is shown at *a*, intermediate positions at *b* and *c*, and the final position of the metal diaphram as formed at *d*. During forming, the pressure above the diaphram 24 in chamber 32 is greater than that below the diaphram 24 in chamber 18. Inert gas in chamber 18 is forced out through vents 90 as the metal diaphram 24 deforms due to the pressure differential.

Figure 4:
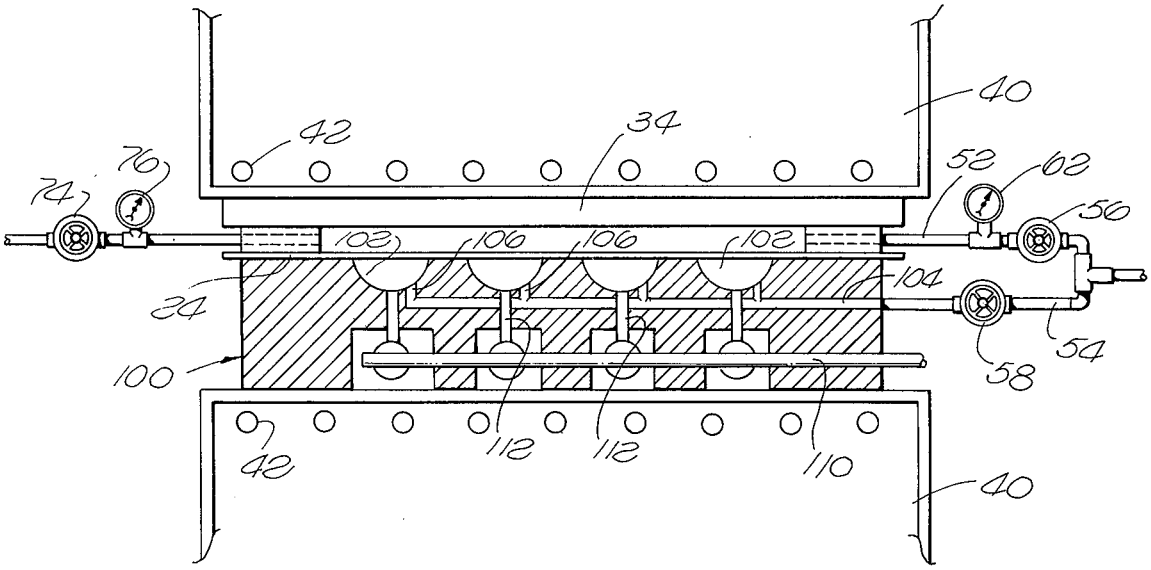
FIG. 4 is a cross-sectional elevational view of a modified apparatus for forming the diaphram into a complex shape.

FIG. 4 illustrates a modification of the present invention. The forming apparatus here employed is used to form a beaded or ridged shape of form from the diaphram. The base plate tool 100 is a preferably unitary structure that replaces the base plate 12 and lower support tooling frame 14 of the FIG. 1 embodiment. Base plate tool 100 has a plurality of cavities 102 equal to the number of ridges desired to be formed in diaphram 24. Cavities 102 replace the chamber 18 of the embodiment in FIG. 1. Inert gas is transmitted from line 54 to cavities 102 by a conduit 104 formed in base plate tool 100. Conduit 104 has individual openings 106 for each cavity 102. Conduit 110 is a vacuum inlet to the cavities 106 and is connected to a suction pump (not shown). Separate channels 112 are provided in conduit 110 for drawing out the inert gas in cavities 106 and for application of vacuum to cavities 106. The diameters of openings 106 and channels 112 are less than the thickness of the diaphram 24 as formed to minimize material flow therein.

Figure 5:
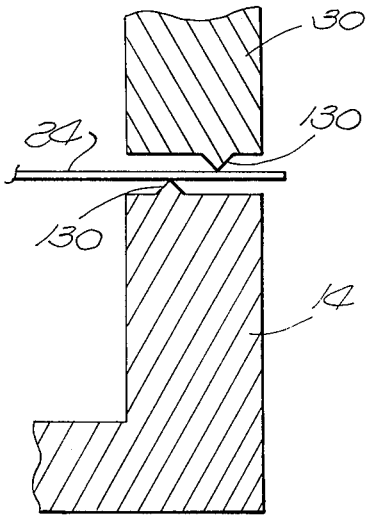
FIG. 5 is a detail view of a sealing method for the forming apparatus.
Figure 6:
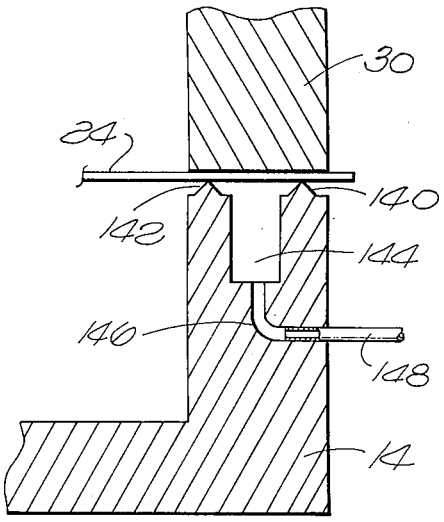
FIG. 6 is a detail view of an alternate seal arrangement for the forming apparatus.

Referring now to FIGS. 1, 5, and 6, there are shown three sealing methods for sealing chambers 18 and 32. These seal methods are optional in that the forming apparatus 10 is sealed by compression from the press platens 40. However, especially when a vacuum is used, it is desirable to have very effective sealing to prevent entrance into chambers 18 and 32 of any contaminating air. Such contamination, if minimal, results in extra labor in cleaning the surface of the formed part, and if more than minimal, may result in the formed part being unsatisfactory for use. The technique illustrated in FIG. 1 uses a pure titanium O-ring 120 which can be combined with an elevated temperature glass base type sealant 122 such as Markal CRT-22 glass-coated sealant, both of which overlie the periphery of the upper side of the lower tooling support frame 14. The elevated temperature sealant can also be placed on the bottom and top sides around the periphery of the upper tooling frame 30 as shown at 124 and 125 respectively in contact with the diaphram 24. The titanium O-ring is extremely soft at the forming temperatures and therefore affects a very good seal. Another technique shown in FIG. 5 uses sharp hard projections 130 that run continuously around the perimeter of the tooling 14 and 30 that penetrate into the softer diaphram 24 at the elevated forming temperatures thereby effecting a seal. In FIG. 6 is shown another method where only the lower tooling 14 is provided with an additional sealing feature. Tooling 14 is provided at its upper side with two sharp projections 140 and 142 which run continuously around the perimeter of the tooling 14 and which penetrate into the metal diaphram 24 at the forming temperature. These projections 140 and 142 contain inert gas in a cavity 144. Inert gas is transmitted to cavity 144 via internal conduit 146 which is connected to line 148 leading to a source of pressurized inert gas. Various combinations of the illustrated sealing techniques are also within the scope of this invention.

OPERATION

Referring to FIGS. 1 and 2, base plate 12 and lower tooling 14 and associated gas lines 52 and 54 are assembled. Sealing means such as sealer 122 and O-ring 120 are applied to lower frame 14 if desired. Shaping member 22 is positioned inside frame 14 and on base plate 12. A suitable metal blank 24 is placed over the frame 14 enclosing chamber 18. Optionally, sealant can be placed on the lower and upper sides of upper frame 30. Upper frame 30 with the connected gas lines 70 and 80 is placed over the metal blank 24. Upper plate 34 is placed over upper frame 30 enclosing chamber 32. The entire forming apparatus 10 is placed inside a press with heated top and bottom ceramic platens 40. Pressure is applied by the press on the forming apparatus 10 for an effective seal. Inert gas is applied to both upper and lower chambers, 32 and 18 respectively, to protect the metal blank 24 from contamination during heating and forming. The temperature of the metal blank 24 is raised by the heating apparatus 42 in platens 40 to a suitable forming temperature. A pressure differential across the principal surfaces of the metal blank 24 causes the metal blank 24 to form against the shaping member 22, and the uncovered portions of lower frame 14 and base plate 12 which may also be shaping members. The pressure differential can be generated by a vacuum in lower chamber 18, increased inert gas pressure in upper chamber 32, or both. The temperature in heating platens 40 is reduced and the metal blank 24 is cooled with the inert gas atmosphere (or vacuum) retained though reduced. The press is raised, forming apparatus 10 disassembled, and the part removed and trimmed to size.

Thus, it is apparent that there has been provided, in accordance with the invention, a method and apparatus for controlled environment superplastic forming of metals that fully satisfies the objectives, aims, and advantages set forth above.

While the invention has been described in conjunction with specific embodiments thereof, it is evident that many alternatives, modifications, and variations, will be apparent to those skilled in the art in light of the foregoing description. Accordingly, it is intended to embrace all such alternatives, modifications, and variations as fall within the spirit and scope of the appended claims.

What is claimed is:

1. A method of making metallic forms in a controlled environment comprising:

providing at least one shaping member having a surface formed complimentary to the shape desired to be formed;

providing a metal blank having an effective strain rate sensitivity and two opposed principal surfaces;

enclosing an area around said metal blank and said at least one shaping member, said enclosed area being divided into first and second chambers by said metal blank, said metal blank being positioned as a diaphram between said chambers, said at least one shaping member being located in said first chamber;

providing an inert gas environment in said chambers;

heating said metal blank to a temperature suitable for superplastic forming; and controlling the fluid pressure of said inert gas within said chambers to induce a pressure loading across the principal surfaces of said metal blank wherein the fluid pressure of said inert gas within said second chamber is greater than the fluid pressure of said inert gas within said first chamber, thereby causing said metal blank to deform into said first chamber and against, and into intimate contact with, said at least one shaping member.

2. A method as defined in claim 1 wherein said metal blank is positioned with its principal opposed surfaces in operative projection with respect to said at least one shaping member.

3. The method as defined in claim 2 wherein said pressure loading across said principal surfaces is applied for a substantial period of time inversely related to the induced tensile stress and said metal blank is stretched substantially in excess of its original surface area.

4. The method as defined in claim 3 wherein said first chamber is vented to allow for efflux of inert gas as said metal blank deforms and thereby reduces the size of said first chamber.

5. The method as defined in claim 3 wherein said pressure loading comprises application of vacuum to said first chamber while maintaining a constant pressure of inert gas in said second chamber.

6. The method as defined in claim 3 wherein said pressure loading comprises application of vacuum to said first chamber and increased pressure of inert gas in said second chamber.

7. The method of claim 3 wherein said inert gas is argon and said metal blank is titanium alloy sheet.

8. The method as defined in claim 7 also including sealing said enclosed area to prevent influx of air into said enclosed area.

9. Apparatus for making metallic forms from metal blank having an effective strain rate sensitivity in a controlled environment comprising:

at least one shaping member having a surface formed complimentary to the shape desired to be formed;

an enclosure around said metal blank and said at least one shaping member, said metal blank being positioned within said enclosure such that said enclosure is divided into first and second separate chambers, said at least one shaping member being located in said first chamber;

means for heating said metal blank to a suitable forming temperature; and an environmental control means for providing an inert gas environment with said chambers during heating and forming of said metal blank and for regulating the inert gas pressure in said first and second chambers to induce a pressure loading across said metal blank to cause said metal blank to deform against, and into intimate contact with, said at least one shaping member.

10. Apparatus as set out in claim 9 wherein said environmental control means includes a vent in said first chamber to allow for efflux of inert gas when the pressure in said second chamber is greater than said first chamber thereby causing said metal blank to deform and reduce the size of said first chamber.

11. Apparatus as set out in claim 9 wherein said environmental control means includes a means for application of vacuum to said first chamber.

12. Apparatus as set out in claim 9 also including sealing means for said enclosure to ensure that the portion of said metal blank to be formed is only exposed to the environment within said enclosure during heating and forming.

13. Apparatus as set out in claim 12 wherein said sealing means includes a press.

14. Apparatus as set out in claim 13 wherein said enclosure comprises upper and lower frame members; said metal blank is positioned between said frame members; and said seal means includes a metal O-ring and a high temperature sealant mounted between said metal blank and said lower frame member and in contact with a single continuous edge of said metal blank.

15. Apparatus as set out in claim 13 wherein said enclosure includes upper and lower frame members; said metal blank is positioned between said frame members; and said sealing means includes a projection on said lower frame member in contact with a continuous edge of said metal blank.

16. Apparatus as set out in claim 13 wherein said enclosure includes upper and lower frame members; said metal blank is mounted between said frame members; and said sealing means includes a pair of projections on said lower frame member in contact with a continuous edge of said metal blank, a cavity in said lower frame member between said projections, and means for providing inert gas to said cavity.

17. Apparatus as set out in claim 12 wherein said inert gas is argon and said metal blank is titanium alloy sheet.

* * * * *

UNITED STATES PATENT AND TRADEMARK OFFICE

CERTIFICATE OF CORRECTION

PATENT NO. : 3,934,441

DATED : January 27, 1976

INVENTOR(S) : CHARLES HOWARD HAMILTON, et al.

It is certified that error appears in the above-identified patent and that said Letters Patent are hereby corrected as shown below:

Column 3, lines 48-51, delete the formula shown and substitute the following formula:

$$m = \frac{d \ln \sigma}{d \ln \dot{\varepsilon}}$$

Column 3, line 56, after "tion of" delete "strain" and insert--Strain--.

Claim 1, line 52, delete "complimentary" and insert--complementary--.

Claim 9, line 48, delete "with" and insert--within--.

Signed and Sealed this

Ninth Day of November 1976

[SEAL]

*Attest:*

RUTH C. MASON
*Attesting Officer*

C. MARSHALL DANN
*Commissioner of Patents and Trademarks*